US005337037A

United States Patent [19]

Guillot et al.

[11] Patent Number: 5,337,037

[45] Date of Patent: Aug. 9, 1994

[54] DEVICE FOR CONTROLLING AT LEAST TWO LUMINOUS CONDITION INDICATING SIGNALS

[75] Inventors: Gerard L. H. Guillot, Radon; Jean-Paul A. Bouleau, Champfleur, both of France

[73] Assignee: Moulinex (Societe Anonyme), Bagnolet, France

[21] Appl. No.: 115,422

[22] Filed: Sep. 2, 1993

[30] Foreign Application Priority Data

Sep. 10, 1992 [FR] France ..... 92 10819

[51] Int. Cl.[5] ..... H01H 37/52; H01H 37/12

[52] U.S. Cl. ..... 337/363; 337/368; 219/248

[58] Field of Search ..... 337/368, 334, 347, 360, 337/376, 37, 57, 82, 94, 41, 42, 43, 363; 219/248, 506

[56] References Cited

U.S. PATENT DOCUMENTS 4,261,120 4/1981 Greco et al. ..... 219/248

4,968,963 11/1990 DeWitt et al. ..... 337/363

*Primary Examiner*—Harold Broome

*Attorney, Agent, or Firm*—Young & Thompson

[57] ABSTRACT

Control device for at least two luminous condition indicating signals (30, 41) mounted on a domestic electrical appliance provided with a quick opening adjustable thermostat (2) which passes over center. An insulating support (13, 14, 15) receives a thermostat arm (11), a blade (16) forming a fixed contact, a movable blade (7) provided with a flexible tongue (20) on which bears an insulating plug (22) controlled by a rotatable screw (10) permitting obtaining a predetermined temperature, and another movable blade (8) fixed to the movable blade (7) and whose free end bears against the fixed contact as well as an insulating partition (9) fixed to the bimetal (6) and controlling the movable blades (7 and 8). The blade forming a fixed contact (16) and the movable blades (7 and 8) are fixed to the insulating support, connected respectively to electrical terminals by electrical connections (3, 4) and supply the two luminous signals (30, 41). A resilient conductive blade (48) having a free end (47) and an end (49) fixed to the insulating support (13, 14, 15), is connected electrically by this end to the terminal (19) and in engagement with the flexible tongue (20) by a bearing member (51). A conductive element (44) is fixed on the insulating partition (9), is connected by an electrical connection to one of the two luminous signals and is adapted to come into contact with the end (47) when the heating temperature is higher than the predetermined temperature.

6 Claims, 1 Drawing Sheet

DEVICE FOR CONTROLLING AT LEAST TWO LUMINOUS CONDITION INDICATING SIGNALS

Figure 1:
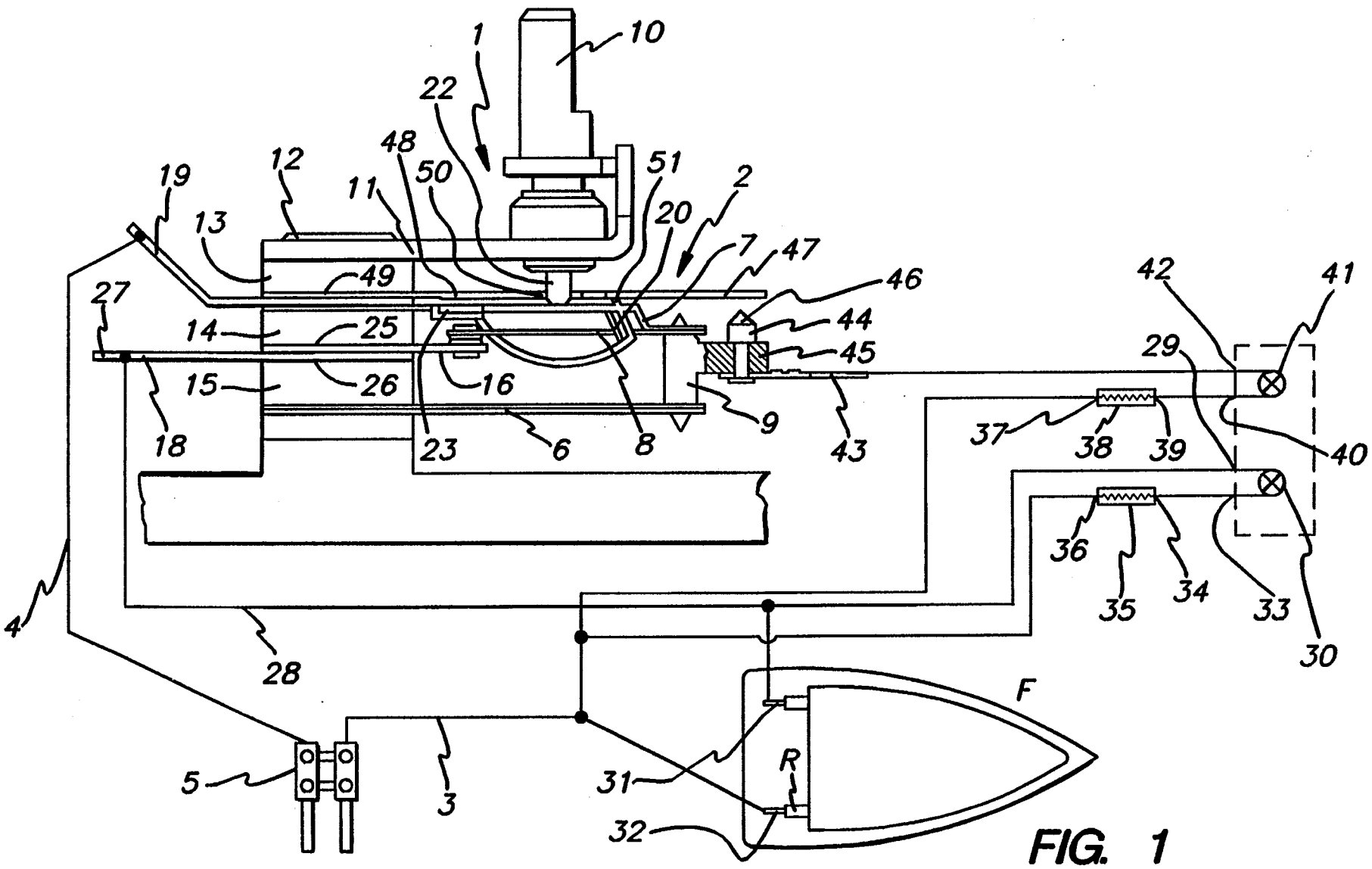

The invention relates to a device for the control of at least two luminous condition indicating signals mounted on a domestic electrical appliance provided with a thermostat adjustable to rapidly open by passage over center, comprising an insulating support receiving an arm of the thermostat, a blade forming a fixed contact, a movable blade provided with a flexible tongue against which bears an insulating plug controlled by a rotatable screw permitting obtaining a predetermined temperature and another movable blade fixed to the movable blade and whose free end bears a contact adapted to bear on the blade forming the fixed contact, as well as an insulating partition integral with the bimetal and controlling the movable blades, the blade forming the fixed contact and the movable blades being fixed to the insulating support, connected respectively to the electrical terminals connected to an electric supply plug, and supplying the two luminous signals.

In domestic electrical appliances such as for example pressing irons, the use of luminous signals for indicating the condition of the temperature of the sole is quite common. The control devices of these luminous condition indicating signals are generally complicated, bulky and costly.

On the other hand, these control devices use electronic devices for information processing from a rapidly opening thermostat and controlling the actuation of the luminous signals. The electronic devices are sensitive to temperature and humidity variations. Moreover, the inclusion of such electronic devices increases considerably the cost of the domestic electrical appliance.

The object of the invention is to overcome the recited drawbacks by using a control device for the luminous signals, which will be mechanical, simple and economical.

According to the invention, the control device of at least two luminous condition indicating signals mounted on a domestic electrical appliance comprises a resilient conductive blade comprising a free end and an end fixed to the insulating support, connected electrically by this end to the terminal and bearing against the flexible tongue by a pressing means, and a conductive element fixed on the insulating partition, connected by an electrical connection to one of the two luminous signals and adapted to come into contact with the free end when the heating temperature is higher than the predetermined temperature.

Thanks to the control arrangement according to the invention, the electronic devices are eliminated and there is thus obtained a limitation of the number of electrical components within the domestic electrical appliance, which decreases the cost of said appliance. On the other hand, the simplicity of said device increases the free space within the domestic electrical appliance, improving the possibilities for arrangement of various elements contained within the domestic electrical appliance.

The characteristics and advantages of the invention will become apparent from the description which follows of an embodiment given by way of non-limiting example illustrated in the accompanying drawing showing in a schematic manner a domestic electrical appliance and the control device of the luminous signals according to the invention associated with a thermostat represented on a different scale.

According to the figure, a thermostat 1 of adjustable type provided with a quick opening device 2 of known type is provided on a domestic electrical appliance, for example a pressing iron F whose part corresponding only to the heating sole is shown. A supply circuit of an electric resistance R heating the sole of the pressing iron comprises electric lines 3 and 4 connected to a plug 5 adapted to be connected to an electrical distribution circuit. Said supply circuit operates with the quick opening device 2 which is displaced by the flexure of a bimetal 6 adapted to transmit movement to two movable blades 7 and 8 via an insulating peg 9 interposed between one end of the bimetal 6 and the ends of each of the movable blades 7 and 8. The movable blade 7 is fixed by one of its ends to the contact 19 of an electric terminal whose other end is fixed to the movable blade 8 whose free end bears a contact adapted to press against a blade 16 forming a fixed contact. The movable blade 7 is provided with a flexible tongue 20 formed for example by cutting out said blade 7 and against which bears an insulating peg 22 controlled by a rotatable screw 10 permitting obtaining a predetermined temperature.

The thermostat 1 also comprises an insulating support constituted of three elements 13, 14 and 15 receiving an arm of a thermostat 11 fixed by a screw 12 and a blade 16 forming a fixed contact. The insulating support by its elements 13, 14 and 15 maintains the electric terminals 18 and 19 connected respectively to the electric lines 3 and 4.

The blade 16 forming a fixed contact comprises an end 25 pressed against an end 26 of the terminal 18, the ends 25 and 26 being positioned between the elements 14 and 15 of the insulating support. The other end 27 of the terminal 18 is connected by an electrical connection 28 to a first connection 29 of a signal 30 and at one end 31 of the resistance R, the other end 32 of the resistance R being connected to the electric line 3 and the plug 5. The second connection 33 of the signal 30 is connected to a terminal 34 of a resistance 35, the other terminal 36 of the resistance 35 being connected to the electric line 3. A terminal 37 of another resistance 38 is also connected to the electric line 3. The other terminal 39 of the resistance 38 is connected to a connection 40 of another signal 41, the other connection 42 of the signal 41 being connected to a terminal 43. Said terminal 43 is secured by a conductive element 44, for example a rivet, on a boss 45 of the insulating plug 9. The boss 45 is connected to the central portion of the insulating plug 9 of which each end is connected respectively to the bimetal 6 and to the movable blades 7 and 8. The rivet 44 has for example a truncated conical end 46 facing which is positioned, at a predetermined distance, an end 47 of a resilient conductive blade 48. The other end 49 of said blade 48 is pressed against the terminal 19, such that the terminal 19, the end of the movable blade 7 and the end of the blade 48 will be positioned between the elements 14 and 13 of the insulating support. The resilient conductive blade 48 is for example a metallic blade comprising a hole 50 through which passes the insulating plug 22. Said metallic blade 48 rests on the flexible tongue 20 by bearing means 51. Said bearing means is for example a lug 51 provided by cutting out from the blade 48. The conductive blade 48 has for example a coefficient of stiffness less than the flexible tongue 20.

The operation of the control device of the luminous signals will be better understood from the explanation which follows.

The rotatable screw 10 of the thermostat 2 is so positioned as to obtain a predetermined temperature. In the example of use with a pressing iron, this predetermined temperature corresponds to the pressing of a particular type of clothing. During connection of the plug 5 to the electrical distribution circuit, the sole of the pressing iron heats up, the luminous signal 30, for example of the color green, lights up because the contact between the end of the blade 16 forming a fixed contact and the free end of the movable blade 8 is closed. Then, during increase to the desired temperature, the free end of the bimetal 6 curves upwardly and tends to raise the end of the movable blades 7 and 8. When passing beyond dead center: the movable blade 8 abruptly leaves the blade forming a fixed contact 16 and comes into abutment against a fixed point 23 of the movable blade 7, and the luminous signal 30, for example designed as a heating signal, is extinguished; the flexible tongue 20 of the movable blade 7 presses on the lug 51 of the metallic blade 48 and spaces said blade 48 from the end 46 of the rivet 44. When the user wishes a temperature below the precedingly required temperature, the user turns in the opposite direction the rotatable screw 10 of the thermostat 2 such that the contact between the end of the blade 16 and the free end of the movable blade 8 will open. The insulating plug 22 therefore bears against the flexible tongue 20 and presses it inward, the lug 51 thus being released. Because of this, the end 47 of the metallic blade 48 comes into contact with the end 46 of rivet 44. This contact triggers illumination of the luminous signal 41, for example red in color, which indicates a too-hot condition of the sole of the pressing iron. This signal extinguishes only when the sole of the pressing iron cools, that is to say when the free end of the bimetal 6 has slightly descended and occupies a position corresponding to the new desired temperature.

The control device of luminous signals according to the invention is applicable to a pressing iron, but can be used on any type of appliance such as ovens, waffle irons, deep fat fryers in which the indication of a too-high temperature must be known by the user.

What is claimed is:

1. In a control device for at least two luminous condition indicating signals (30, 41) mounted on a domestic electrical appliance provided with a quick opening adjustable thermostat (2) which passes over center, comprising an insulating support (13, 14, 15) receiving a thermostat arm (11), a blade (16) forming a fixed contact, a movable blade (7) provided with a flexible tongue (20) on which bears an insulating plug (22) controlled by a rotatable screw (10) permitting obtaining a predetermined temperature, and another movable blade (8) fixed to the movable blade (7) and whose free end bears against the fixed contact as well as an insulating partition (9) fixed to the bimetal (6) and controlling the movable blades (7 and 8), the blade forming a fixed contact (16) and the movable blades (7 and 8) being fixed to the insulating support, connected respectively to electrical terminals by electrical connections (3, 4) and supplying the two luminous signals (30, 41); the improvement wherein the device further comprises a resilient conductive blade (48) having a free end (47) and an end (49) fixed to the insulating support (13, 14, 15), connected electrically by this end to the terminal (19) and in engagement with the flexible tongue (20) by pressing means (51), and a conductive element (44) fixed on the insulating partition (9), connected by an electrical connection to one of the two luminous signals and adapted to come into contact with the free end (47) of the resilient conductive blade when the heating temperature is higher than the predetermined temperature.

2. Control device of at least two luminous condition indicating signals according to claim 1, wherein the conductive blade (48) is a metallic blade having a coefficient of stiffness less than the flexible tongue (20).

3. Control device of at least two luminous condition indicating signals according to claim 2, wherein the metallic blade (48) comprises a hole (50) through which passes the insulating plug (22).

4. Control device of at least two luminous condition indicating signals according to claim 3, wherein the pressing means (51) is a lug provided by cutting out from the resilient conductive blade (48).

5. Control device of at least two luminous condition indicating signals according to claim 1, wherein one said luminous signal (30) is green and the other said luminous signal (41) is red.

6. Control device of at least two luminous condition indicating signals according to claim 1, which is mounted on a pressing iron.

* * * * *